US005717046A

United States Patent [19]

Shin et al.

[11] Patent Number: 5,717,046

[45] Date of Patent: Feb. 10, 1998

[54] RETENTION AIDS FOR PAPERMAKING

[75] Inventors: Jong Ho Shin; Sin Ho Han; Say Kyoun Ow, all of Daejeon, Rep. of Korea

[73] Assignee: Korea Research Institute of Chemical Technology, Rep. of Korea

[21] Appl. No.: 583,050

[22] PCT Filed: Jul. 20, 1994

[86] PCT No.: PCT/KR94/00097

§ 371 Date: Jan. 19, 1996

§ 102(e) Date: Jan. 19, 1996

[87] PCT Pub. No.: WO95/03450

PCT Pub. Date: Feb. 2, 1995

[30] Foreign Application Priority Data

Jul. 20, 1993 [KR] Rep. of Korea ..... 93-13673

[51] Int. Cl.[6] ..... C08F 24/00; C08F 20/58; C08F 20/60; C08F 26/02; C08F 20/18; C08F 16/12

[52] U.S. Cl. ..... 526/266; 526/307; 526/304; 526/310; 526/328; 526/333

[58] Field of Search ..... 526/307, 266, 526/304, 310, 328, 333

[56] References Cited

FOREIGN PATENT DOCUMENTS

| | | |
|---|---|---|
| 63-235596 | 9/1988 | Japan . |
| 64-45899 | 2/1989 | Japan . |
| 4-55405 | 2/1992 | Japan . |

OTHER PUBLICATIONS

R.I.S. Gill, "Developments in Retention Aid Technology", International Business Sector—Paper, dated Feb. 1987, pp. 34–40.

D. Horn et al.; "Retention Aids", Paper Chemistry, Ed. J. C. Robers, Blackie & Son Ltd., Glasgow 1991, Chapter 4.

Phillipe A. Ford, "Control the Wet End Balancing Act With Polymer/Pigment Microparticles"; TAPPI Proceedings, 1991 Papermakers Conference pp. 501–504.

Gallagher, "High Performance Alkaline Retnetion Programs", 1990 Neutral/Alkaline Papermaking, TAPPI Short Course Notes, pp. 141–144.

Kurt Moberg, "Microparticles in Wet End Chemistry", 1989 Retention and Drainage, TAPPI Short Course, pp. 65–86.

*Primary Examiner*—Joseph L. Schofer
*Assistant Examiner*—Wu C. Cheng
*Attorney, Agent, or Firm*—Finnegan, Henderson, Farabow, Garrett, & Dunner L.L.P.

[57] ABSTRACT

The present invention relates to retention aids for papermaking, in particular which comprise cationic multi-armed star-like polymers of formula (I):

(I)

as an effective component to improve the retention of fines fraction by structural characteristics of multiarmed polymer chains connected with one starting point on the compound. In formula (I), A is or B is —O— or —COO—; D is —OH;
E is F is wherein, $R^1$—$R^{11}$ are independently hydrogen or alkyl; $R_a$—$R_d$ are independently hydrogen or alkyl; $X^-$ is x is an integer selected from 3 to 24; y is an integer selected from 0 to 21; n is an integer selected from 3 to 6; p is an integer selected from 300 to 4000; and q is an integer selected from 0 to 1000.

6 Claims, 3 Drawing Sheets

| | | |
|---|---|---|
| Blank | : | Control Standard group |
| N-PAM | : | Anionic linear polyacrylamide |
| C-PAM | : | Cationic linear polyacrylamide |
| CMS-PAM | : | Star-like cationic polyacrylamide of the present invention |
| CD-5, BMB | : | Comparative Standard group |

RETENTION AIDS FOR PAPERMAKING

FIELD OF THE INVENTION

The present invention relates to retention aids for papermaking, in particular which comprise cationic multi-armed star-like polymers (hereinafter, it is referred to as CMS-PAM) of the following formula(I) as an effective component to improve the retention of fines fraction by structural characteristics of multiarmed polymer chains connected with one starting point on the compound.

$$(A)\text{+}B-(CH_2)_n-(E)_p-(F)_q\text{+}_x \qquad (I)$$

Wherein,

A is $C(CH_2-)_4$, $(-CH_2)_3CCH_2OCH_2C(CH_2-)_3$, $\text{+}(CH_2)_3CCH_2OCH_2C(CH_2-)_2CH_2OCH_2C(CH_2\text{+})_3$, $\text{+}(CH_2)_3CCH_2OCH_2C(CH_2-)_2CH_2OCH_2C(CH_2\text{+})_3$,

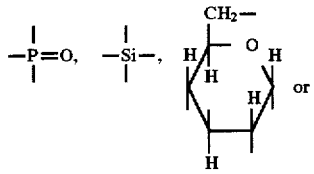

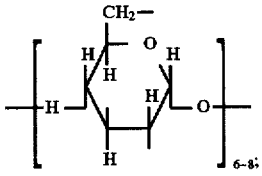

B is —O— or —COO—;
D is —OH;
E is

B is —O— or —COO—;
D is —OH;
E is

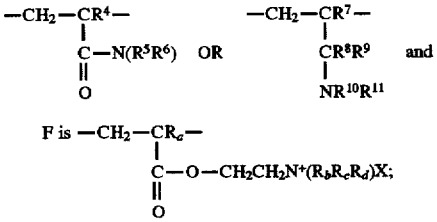

and wherein, $R^1$~$R^{11}$ is respectively hydrogen atom or alkyl group;
$R_a$~$R_d$ is respectively hydrogen atom or alkyl group;
X is

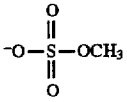

or $Cl^-$;
x is an integer selected from 3 to 24;
y is an integer selected from 0 to 21;
n is an integer selected from 3 to 6;

p is an integer selected from 300 to 4000; and
q is an integer selected from 0 to 1000.

BACKGROUND OF THE INVENTION

Generally, the paper is almost made by using natural wood pulp as the main material, but recently to reuse the resources, the wastepaper using the cycled fiber is produced in large quantities. In the papermaking process, the refining is required to improve paper intensity and uniformity during the papermaking, to increase the strength and to decrease the porosity. Then the fines fraction is plentifully produced during the fibrilation by refining. During the process for papermaking, the filler is almost added for the objective of surface evenness and brightness and improved printability. Polystyrenes are used as the organic filler, and talc, calcium carbonate, titanium dioxide, etc. are typically used as the inorganic filler. But the inorganic filler is used except a special use. Otherwise, sizing agents are added to provide the resistance against liquid penetration, and then rosin, wax emulsions or synthesic sizes are used as the sizing agent.

In the process of papermaking, fines fraction means one lower than 76 μm(200 mesh) of the papermaking stock compositions, so the said fine fibers, fillers and sizing agents are fines fraction. These fines fractions are more than 50% of the common papermaking stock compositions.

However, said fines fraction may be easily removed out by dewatering, and as the result of disappearance of the used materials the cost is increased and the properties are decreased inevitably. Also, since the plenty of fines fractions in white water are accumulated, there are many problems that pitch can be occured and white water line cannot be. Therefore, to improve the properties of final paper products and simultaneously to solve the above problems in the papermaking process, it is necessary to increase the retention.

But since it is impossible to increase the retention only by mechanical or processing operation, it is effective to add chemicals such as retention aids. The retention aids are classified to inorganics, natural organics and water-soluble synthetic polymer electrolytes. Aluminium salt such as aluminium sulfate, "Alum", is typically used as the inorganic retention aids, and cationic starchs is generally used as the natural organic retention aids.

Recently, water-soluble synthetic polymer electrolytes are widely used, for example polyacrylamide (Cationic- or Anionic-PAM), polyethylene imine, polyamine, polyamideamine, polyethylene oxide and various polymer electroyles having pyrrolidinium group synthesized from diallyldimethylammonium chloride. And otherwise, the compounds and the used-examples for retention aid are disclosed on Horn's literature [D. Horn and H. Linhart., "Retention Aids" in paper chemistry, Ed. J. C. Roberts, Blackie & Son Ltd., Glasgow 1991, Chapter4]. These polymer electrolytes have been used since 1950's when they were introduced on papermaking process, but there is no satisfactory electrolyte to solve the various problems on the process.

Thus, although the development of new polymer electrolyte is needed, the reasons why it does not get out of the conventional electrolyte are that a desirable polymer electrolyte must have a more complicated requirements as the following; it has to be water-soluble substance to be used in water, its molecular weight has to be more than at least one million, and if possible, it has to be cationic substance since the used fine particles are almost anionic substance.

Therefore, recently the development has been concentrated on retention system, not retention aid, in particular microparticle system using cationic linear polymer with inorganic substance [Gill, R.I.S., Paper Technology, vol.32, No.8, 32–41(1991)/Ford, P.A.,TAPPI Papermakers Conference Proceedings, 501–504(1991)/Gallagher, T. M., TAPPI Neutral/Alkaline Papermaking Short Course Notes, 141–144(1990)/Moberg, K., TAPPI Retention And Drainage Short Course Notes, 65–86(1989)].

But, since the cationic polymer used for the above system has a great molecular weight, paper formation may be decreased due to large flocculates. And since molecular structure is linear type, it has a fault that if the flocculates pass through the section suffering strong shearing stress such as fan pump or screen, the flocculates break. These retention systems also complicate the application in papermaking process due to very sensitive properties according to the applied process.

Therefore, the present inventors have completed the present invention consedering that if a polymer electrolyte has three-dimensional structure as a new compound not used in prior art, its flocculation behavior differs from the known linear polymer electrolyte.

SUMMARY OF THE INVENTION

The objective of the present invention is to provide new retention aids for papermaking having excellent retention effect and suitability in papermaking process by using new compounds of CMS-PAM which are cationic multiarmed star-like polymer electrolyte. The present invention relates to retention aids for paper making characterized by comprising the following formula(I) as effective component.

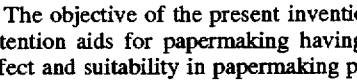

$$(D)_y-(A)+B-(CH_2)_m-(CH=CH_2)]_x \quad (II)$$

DETAILED DESCRIPTION OF THE INVENTION

Figure 1:
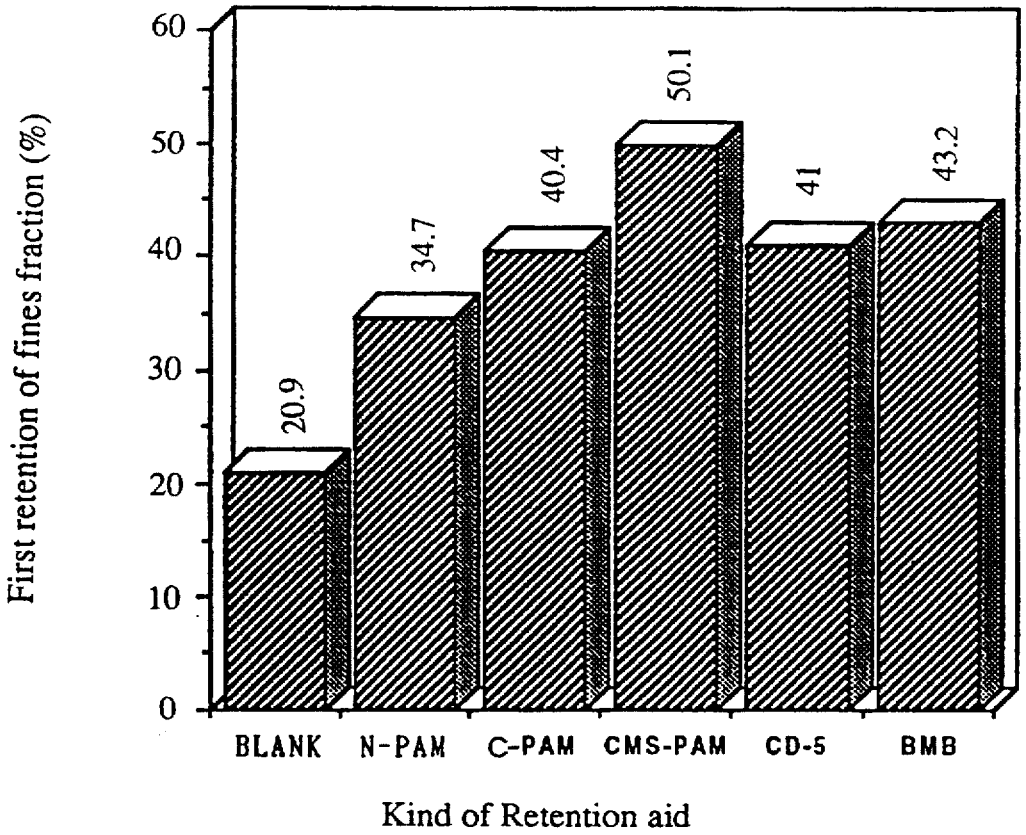
FIG. 1 is a graph showing test result of first pass fines retention(%) of papermaking stock by use of retention aids according to the present invention.

The said formula(I) is prepared by polymerizing the following formula(II) as starting material with water-soluble monomers and cationic monomers, and then the said formula(II) is prepared by reacting polyfunctional compound with unsaturated polymerizable compound.

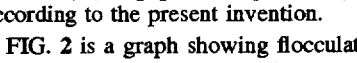

$$(D)_y-(A)+B-(CH_2)_m-(CH=CH_2)]_x \quad (II)$$

Wherein, D,A,B,y and x are defined as the above; and m is an integer selected from 1 to 4.

According to the present invention, the said polyfunctional compounds may be selected from the group of polyols such as glycerol, monopentaerythritol, dipentaerythritol, tripentaerythritol, glucose or cyclodextrin; polyfuncitonal amine such as triaminopyrimidine or tris(2-aminoethyl) amine; and phosphorus compound such as hexachlorocyclotriphosphazene or phosphoric acid, in amount of 0. 1 mol %. And the said unsaturated polymerizable compound may be selected from the group of acrylic acid, metacrylic acid and allylbromide in range of 0.3 to 3.0 mol %. The said formula (I) of the present invention is prepared by polymerizing with the said formula(II) of 0.0001~0.001 mol % during process of copolymerizing water-soluble monomers with cationic monomers.

The said water-soluble monomers may be selected from acrylamide (AM) and allylamine, in amount of 0.2 mol %, and the said cationic monomer having cationic group such as ammonium, sulfonium or phosphonium salt may be selected from the group of dimethyl aminoethyl acrylate methylchloride(DMAEA), diallyldimethyl ammonium chloride and dimethyl aminoethyl metacrylate dimethylsulfate, in range of 0.03 to 0.07 mol %. If the used content of said cationic monomer is less than 0.03 mol %, cation charge density is decreased. If the content is more than 0.07 mol %, the molecular weight of polymer is decreaed.

The process for preparing retention aids according to the present invention may be detailed as follows:

Toluene of a suitable content is mixed with pentaerythritol as polyfunctional compound, acrylic acid as a compound having polymerizable functional group, perfluoroalkylsulfonic acid resin as acid catalyst and para-methoxyphenol as polymerization inhibitor. After dissolving the solution, the reactant is heated under oxygen atmosphere for many hours, and then reacting by-product, water, is continuously removed to obtain the compound of said formula(II). On the other hand, AM monomer, DMAEA(cationic monomer) and ammonium persulfate(APS, initiator) are dissolved in suitable amount of water, and the reactant is poured in reactor to heat under nitrogen atmosphere. After some hours, the compound of said formula(II) dissolved in a small amount of methanol is slowly added to the reactor. The solution is reacted for some hours to obtain CMS-PAM of the said formula(I). The said CMS-PAM is used in range of 0.01 to 1 wt % for the concentration of pulp furnish in front and rear of mixing tank or fan pump.

According to the present invention, the said CMS-PAM may be used as retention aid together with inorganic compound such as silica or bentonite of 0.05 to 2 wt % for the concentration of pulp furnish to give the uniformity of distribution for particles size flocculated in papermaking process. CMS-PAM used in the present invention has the viscosity of 20~1000 cps as the result measured by Brookfield viscometer, and the great effect for flocculation of inorganic fillers such as titanium dioxide, calcium carbonate or talc, fine fiber or sizing agents such as alkyketone dimer, alkenylsuccinic anhydride and rosin sizes.

The retention aids for making paper of the present invention comprising CMS-PAM of the said formula(I) have excellent applicability on the papermaking process as the followings; retaining paper properties during high filled paper, maintaining flocculation ability under high shearing stress, preserving uniform particle distribution, and in particular having excellent capablity for increasing retention of fines fraction. Therefore, the retention aids according to the present invention may be used very widely as a retention aid for making paper or a flocculant for treating waste water. The present invention may be illustrated in more detail as following examples, but it is not limited by the examples.

EXAMPLE 1~9

Toluene of 150~200 ml was mixed with pentaerythritol of 0.1 mol as a polyfunctional compound, acrylic acid of 0.4~0.7 mol as a compound having polymerizable functional group, perfluoroalkylsulfonic acid resin of 30~70 g as an acid catalyst and para-methoxyphenol of 0.02~0.05 g as a polymerization inhibitor. The reactant was heated at 120°~140° C. under oxygen atmosphere for 3~5 hours, and then by-product, water, was removed continuously.

The residual acid resin was removed by filtering when the reaction was finished, and the solution was neutralized by sodium bicarbonate and washed with distilled water several times. The used toluene was evaporated under reduced pressure to obtain monopentaerythritol triacrylate(PETA) having polymerization functional groups of 3 units.

According to the polymerization condition of following Table 1, AM,DMAEA and APS were dissolved in water of 80~200 ml and the solution was poured into the reactor to heat at 30°~65° C. under nitrogen atmosphere. After reacting the solution, for 5–30 minutes, when the viscosity of said solution was increased to some degree, the said PETA dissolved in methanol of 2~10 ml according to the polymerization condition of the following Table 1 was slowly added for 3~15 mins.

After intensely stirring the solution for 2~4 hours, the desired polymer electrolytes were obtained as tri-armed cationic polymer compound.

Test results for properties of the obtained polymer electrolytes were shown in Table 1.

TABLE 1

| EXAMPLE | AM[1] (mol) | DMAEA[2] (mol) | PETA[3] (mol) | APS[4] (mol) | Viscosity (cPs) (0.1% concentration) | electric density (meq/g) (pH 7.0) |
|---|---|---|---|---|---|---|
| 1 | 0.2 | 0.05 | $3.4 \times 10^{-5}$ | $2.5 \times 10^{-4}$ | 450 | 1.35 |
| 2 | 0.2 | 0.05 | $1.0 \times 10^{-4}$ | $2.5 \times 10^{-4}$ | 396 | 1.21 |
| 3 | 0.2 | 0.05 | $2.5 \times 10^{-4}$ | $2.5 \times 10^{-4}$ | 328 | 1.40 |
| 4 | 0.2 | 0.05 | $3.4 \times 10^{-5}$ | $5.0 \times 10^{-4}$ | 276 | 1.29 |
| 5 | 0.2 | 0.05 | $1.0 \times 10^{-4}$ | $5.0 \times 10^{-4}$ | 254 | 1.36 |
| 6 | 0.2 | 0.05 | $2.5 \times 10^{-4}$ | $5.0 \times 10^{-4}$ | 260 | 1.20 |
| 7 | 0.2 | 0.03 | $2.5 \times 10^{-4}$ | $5.0 \times 10^{-4}$ | 362 | 0.89 |
| 8 | 0.2 | 0.07 | $2.5 \times 10^{-4}$ | $5.0 \times 10^{-4}$ | 140 | 1.41 |
| 9 | 0.2 | 0.10 | $2.5 \times 10^{-4}$ | $5.0 \times 10^{-4}$ | 86 | 1.40 |

[Note]
[1]Acrylamide
[2]Dimethylaminoethylacrylate methylchloride
[3]Monopentaerythrytoltriacrylate
[4]Ammonium persulfate

TEST

To test the retention effect of the polymer electrolytes prepared by said Examples 1 to 9, standard test method of Technical Association of Pulp and Paper Industry (TAPPI), namely T261pm-79 method(that is, Britt Jar-method) was used. In order to perform comparative test, comparative test samples were prepared as followings; control standard with no retention aid, Hydrocol system prepared by CD-5 (Allied Colloids' product, United Kingdom) and bentonitc and Compozil system prepared by BMB(Eka Novel's product, Sweden) and silica.

HwBKP(Hardwod bleached Kraft pulp) of 1.56 g having freeness 400 ml and calcium carbonate of 0.94 g were put in TAPPI standard freeness tester of 1 l volume installed with 200 mesh wire, and diluted with water up to 500 ml. Under stirring at 750 rpm, polymer flocculate of 0.01~1 wt % for the pulp furnish was added after 20 sec, and silica or bentonitc of 0.05~0.4 wt % for pulp furnish was added after 30 sec from that time.

Drain was started after 15 sec, and then drain solution obtained for 5 sec was thrown. Drain solution obtained for next 30 sec was collected to measure the volume and the dry weight for the solid in the collected drain solution.

The first pass fines retention(%) was calculated from the above test according to the formula. Test result of retention for fines fraction is shown in FIG. 1.

First Pass Fines Retention (%) =

$$\frac{(\text{Stock consistency} \times FF) - \text{Consistency of white water}}{(\text{Stock consistency} \times FF)} \times 100$$

wherein,

Consistency of White Water (%) =

$$\frac{\text{Dry weight for fines fraction in drain solution}}{\text{Volume for drain solution}} \times 100$$

*FF*(Fines Fraction)(content % of total fine fraction existing in pulp furnish) =

$$\left[1 - \frac{\text{Weight of the component not passing 200 mesh screen}}{\text{Weight of total solid fraction comprised in 500 ml sample}}\right] \times 100$$

As the result of the above calculation, the case using CMS-PAM has more excellent retention than the control standard groups(Blank) with no retention aids and the comparative sample groups using polyacrylamide(C-PAM), CD-5 or BMB as shown in FIG. 1.

Also, since CD-5 and BMB of the comparative sample group adopted microparticle system using together with bentonite and silica, respectively under the condition close to the paper making process using such microparticle system, the flocculation behavior of titanium dioxide according to the retention aids of the present invention in microparticle system observed by dependency of the mean particle size in accordance with the velocity of centrifugal pump.

Figure 2:
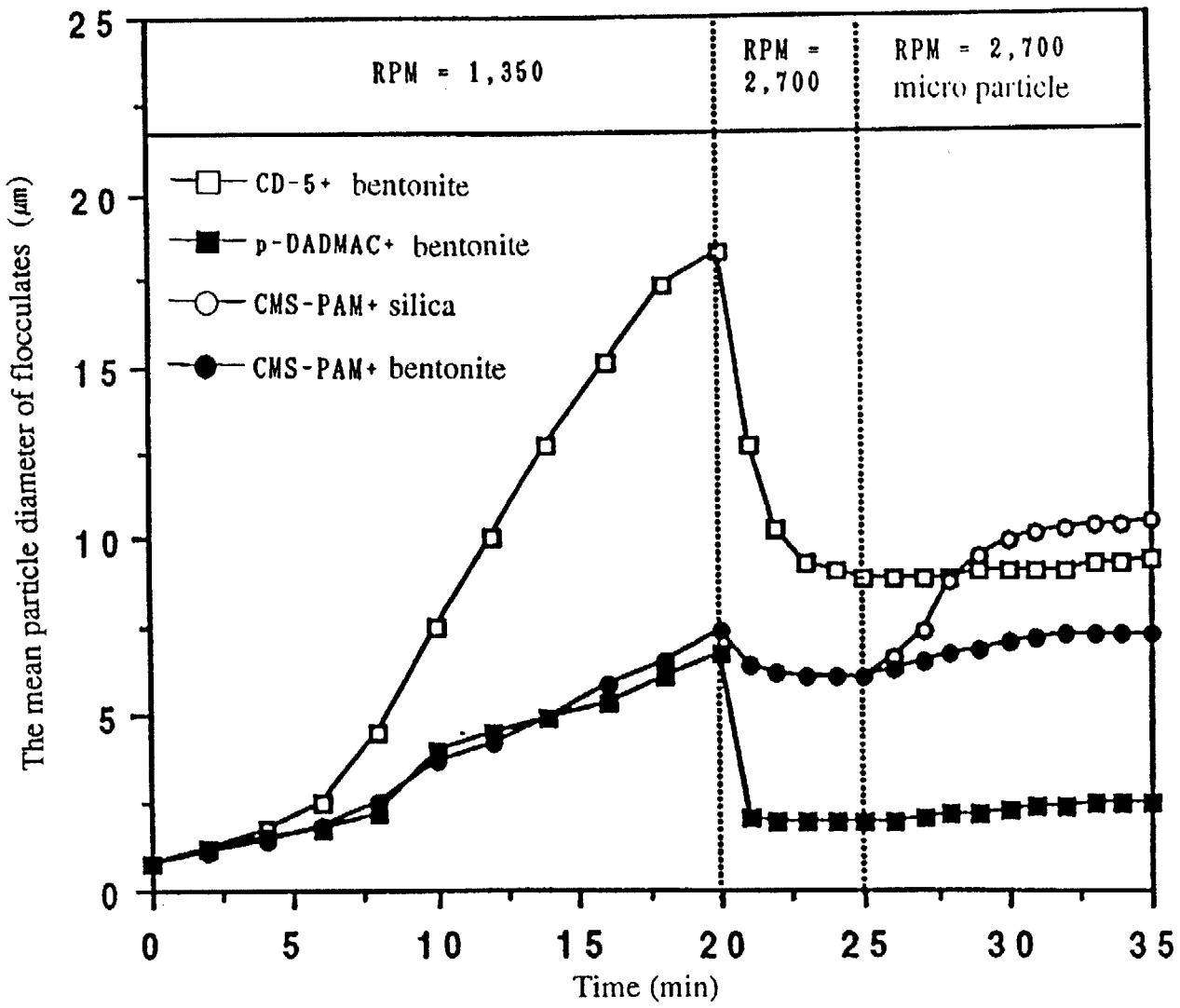
FIG. 2 is a graph showing flocculation behavior of titanium dioxide by retention aids according to the present invention as a dependency of the mean particle size according to the velocity of centrifugal pump.

As shown in FIG. 2, when the velocity of centrifugal pump is 1,350 rpm, the mean particle size of C-PAM or poly(diallyldimethylammonium chloride)(p-DADMAC) was increased with the passage of time, but when the velocity of pump is increased to two times, the particle size was decreased rapidly.

However, it is found that even though the velocity of pump was increased, CMS-PAM of the present invention was hardly influenced by its velocity.

When microparticle such as silica or bentonite was added, the increased degree of particle size was more excellent than the other comparative sample groups. All of p-DADMAC used for comparative sample and CMS-PAM used in the present invention have the molecular weight of about 200~300 thousand. Nevertheless, the remarkable difference as the above means that the star-liked structure of CMS-PAM shows an excellent performance for the flocculation of fines fraction.

One of the main characteristics of retention aid is uniformity of the flocculated particle size, which makes it possible to retain flocculates without decreasing paper formation.

Figure 3:
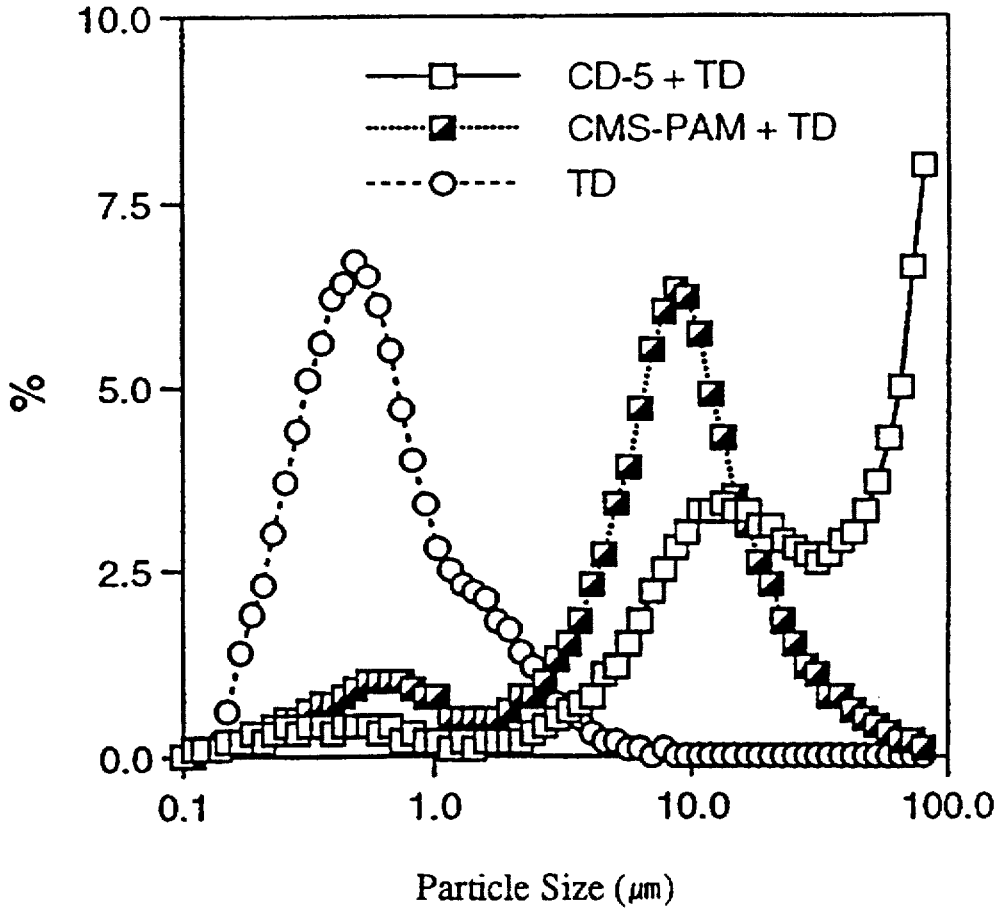
FIG. 3 shows curve of particle size distribution for titanium dioxide flocculate by retention aids according to the present invention.

FIG. 3 shows the degree of particle distribution for titanium dioxide(TD) flocculate by retention aid of the present invention. The curve of particle size distribution for TD flocculated by CMS-PAM forms very uniform Gaussian distribution. But the curve of a comparative sample group CD-5 forms bi-modal curve. This means that the particle size distribution is ununiform and the particle size is very large. Wherein, TD curve shows the particle size distribution of common titanium dioxide not using any retention aids.

What is claimed is:

1. A retention aid comprising a compound of formula (I):

$$(D)_y-(A)\left[B-(CH_2)_n-(E)_p-(F)_q\right]_x \quad (I)$$

wherein, A is $$C(CH_2)_4,$$

$$(CH_2)_3CCH_2OCH_2C(CH_2)_3,$$

$$(CH_2)_3CCH_2OCH_2C(CH_2)_2CH_2OCH_2C(CH_2)_3,$$

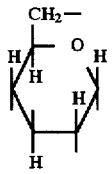

or

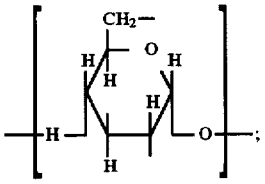

B is —O— or —COO—

D is —OH

E is

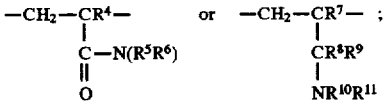

F is

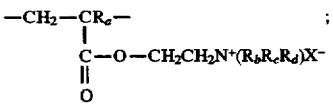

and wherein, $R^1$—$R^{11}$ are independently hydrogen or alkyl;

$R_a$—$R_d$ are independently hydrogen or alkyl;

X is

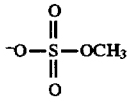

or $Cl^-$;

x is an integer selected from 3 to 24;

y is an integer selected from 0 to 21;

n is an integer selected from 3 to 6;

p is an integer selected from 300 to 4000; and q is an integer selected from 0 to 1000.

2. A method for preparing a compound of formula (I) comprising polymerizing a compound of formula (II) with water-soluble monomers and cationic monomers:

$$(D)_y-(A)\left[B-(CH_2)_m-(CH=CH_2)\right]_x \quad (II)$$

$$(D)_y-(A)\left[B-(CH_2)_n-(E)_p-(F)_q\right]_x \quad (I)$$

$$(D)_y-(A)\left[B-(CH_2)_n-(E)_p-(F)_q\right]_x \quad (I)$$

wherein, A is $$C(CH_2)_4,$$

$$(CH_2)_3CCH_2OCH_2C(CH_2)_3,$$

$$(CH_2)_3CCH_2OCH_2C(CH_2)_2CH_2OCH_2C(CH_2)_3,$$

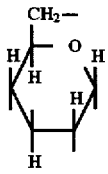

or

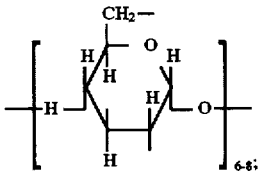

B is —O— or —COO—;

D is —OH;

E is

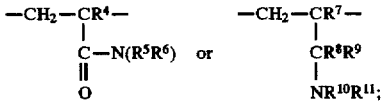

F is

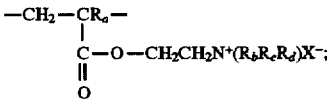

and wherein, $R^1$—$R^{11}$ are independently hydrogen or alkyl;

$R_a$—$R_d$ are independently hydrogen or alkyl;

$X^-$ is

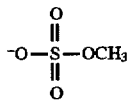

or $Cl^-$;

x is an integer selected from 3 to 24;

y is an integer selected from 0 to 21;

m is an integer selected form 1 to 4;

n is an integer selected from 3 to 6;

p is an integer selected from 300 to 4000; and q is an integer selected from 0 to 1000.

3. A retention aid according to claim 1, wherein said compound comprises about 0.01 to about 1 wt % for the concentration of pulp furnish in front and rear of mixing tank or fan pump.

4. A retention aid according to claim 1, further comprising silica or bentonite of about 0.05 to about 2 wt % for the concentration of pulp furnish.

5. A retention aid according to claim 1, wherein the viscosity of said compound is about 20 to about 1000 cPs.

6. A retention aid according to claim 1, wherein said compound is used for flocculating titanium dioxide, calcium carbonate, talc, fine fiber or sizing agents.

* * * * *

UNITED STATES PATENT AND TRADEMARK OFFICE

CERTIFICATE OF CORRECTION

PATENT NO.: 5,717,046

DATED: February 10, 1998

INVENTOR(S): Jong Ho Shin; Sin Ho Han; Say Kyoun Ow

It is certified that an error appears in the above-identified patent and that said Letters Patent is hereby corrected as shown below:

Claim 2, col. 8, line 26, delete formula (I) (second occurence).

Signed and Sealed this

Twenty-first Day of April, 1998

Bruce Lehman

*Attest:*

BRUCE LEHMAN

*Attesting Officer*

*Commissioner of Patents and Trademarks*